US005962087A

United States Patent [19]

Ruschak et al.

[11] Patent Number: 5,962,087

[45] Date of Patent: Oct. 5, 1999

[54] BOOK AND FIGURINE COMBINATION

[75] Inventors: Lynette R. Ruschak; James R. Diaz, both of Santa Fe, N.Mex.

[73] Assignee: White Heat Ltd., Santa Fe, N.Mex.

[21] Appl. No.: 08/938,279

[22] Filed: Sep. 26, 1997

[51] Int. Cl.[6] ..... B42D 1/00

[52] U.S. Cl. ..... 428/16; 281/15.1; 281/21.1; 281/36; 428/43

[58] Field of Search ..... 428/12, 3, 16, 428/43; 281/15.1, 21.1, 22, 36, 37; 434/178, 428, 429

[56] References Cited

U.S. PATENT DOCUMENTS

| | | | |
|---|---|---|---|
| 1,405,134 | 1/1922 | Hoyme | 434/178 |
| 2,548,043 | 4/1951 | Muhlhauser et al. | 281/42 |
| 2,946,137 | 7/1960 | Worth et al. | 434/178 |
| 3,316,669 | 5/1967 | Nachbar | 40/620 |
| 4,176,473 | 12/1979 | Rae | 434/429 |
| 4,365,438 | 12/1982 | Nelson | 446/75 |
| 4,597,743 | 7/1986 | Becker et al. | 446/71 |
| 4,616,851 | 10/1986 | Mann | 281/43 |

OTHER PUBLICATIONS

A Silly Spine Books™ entitled "Cheese!", by Damon Burnard, White Heat Ltd., Santa Fe, New Mexico (1996). Copy of Cover only.

A Silly Spine Books™ entitled "Catch!", by Damon Burnard, White Heat Ltd., Santa Fe, New Mexico (1996). Copy of Cover only.

*Primary Examiner*—Henry F. Epstein

[57] ABSTRACT

A printed article such as a book structure or assembly comprising a plurality of pages including printing thereon, each of said pages characterized as having a defined cutout region, said pages joined together at a spine such that the cutout region in each page is in alignment with each other cutout region, said figurine attached to said printed article at said spine within said defined cutout region.

11 Claims, 2 Drawing Sheets

BOOK AND FIGURINE COMBINATION

FIELD OF THE INVENTION

The present invention relates to a printed article such as a book, e.g., a children's book, and more particularly to a combination printed article including a figurine assembled within a cutout in the spine of the printed article.

BACKGROUND OF THE INVENTION

Numerous books are continually developed with features designed to attract the interest of children. For example, books have been developed including interactive stickers, while other books include sound or light generators to give visual or auditory interactions. Books have been given irregular shapes, i.e., non-rectangular shapes, so as to resemble various symbols, characters or animals. Books have included a variety of paper pop-up or pull-out illustrations or figures to attract and interest the child. Still other books have incorporated a non-cellulosic toy or figurine in some fashion within the confines of the book.

Among the books including three-dimensional figurines are U.S. Pat. No. 4,176,473 wherein a book includes one or more three-dimensional figures frictionally held within cut-outs within a page or pages of the book. U.S. Pat. No. 4,365,438 included a toy such as a toy vehicle together with the book, the toy capable of occupying a cut-out region within multiple pages of the book for storage and/or display.

Another previous book design including an object within the spine of the book was developed by Ruschak et al. and included a ball within a spherical cutout of a book spine and a piece of cheese within a rectangular cutout of a book spine.

Despite all the prior variations in books including three dimensional figurines, other variations are continually sought, e.g., to help promote the use and reading of children's books, or to serve as an appealing advertisement or promotion.

It is an object of the present invention to provide a book structure or assembly including a three-dimensional figurine attached at the spine of the book.

It is a further object of the invention to provide a book structure or assembly including a three-dimensional figurine attached at the spine of the book with graphic printing cooperatively arranged to provide a storyline involving the figurine.

Still another object of the invention is to provide a book structure or assembly including a three-dimensional figurine attached at the spine of the book, the figurine characterized as having non-symmetrical features, and the book structure including a cut-out region at the spine configured for cooperative arrangement with the figurine.

Yet another object of the present invention is to provide a promotional article including a three-dimensional figurine attached at the spine of the promotional article.

SUMMARY OF THE INVENTION

To achieve the foregoing and other objects, and in accordance with the purposes of the present invention, as embodied and broadly described herein, the present invention provides a printed article including a plurality of pages having printing thereon, each of said pages characterized as having a defined cutout region, said pages joined together at a spine such that the cutout region in each page is in alignment with each other cutout region, and a figurine characterized as having no more than a single plane of reflection, said figurine attached to said printed article at said spine by a securing means within said defined cutout region.

In another embodiment, the present invention provides a promotional article including a plurality of pages having printing thereon, each of said pages characterized as having a defined cutout region, said pages joined together at a spine such that the cutout region in each page is in alignment with each other cutout region, and a promotional figurine representative of a recognizable product, said figurine attached at said spine by a securing means within said defined cutout region.

The present invention also provides a book or printed article including a plurality of pages having printing thereon, each of said pages characterized as having a defined cutout region, said pages joined together at a spine such that the cutout region in each page is in alignment with each other cutout region.

DETAILED DESCRIPTION

Figure 1:
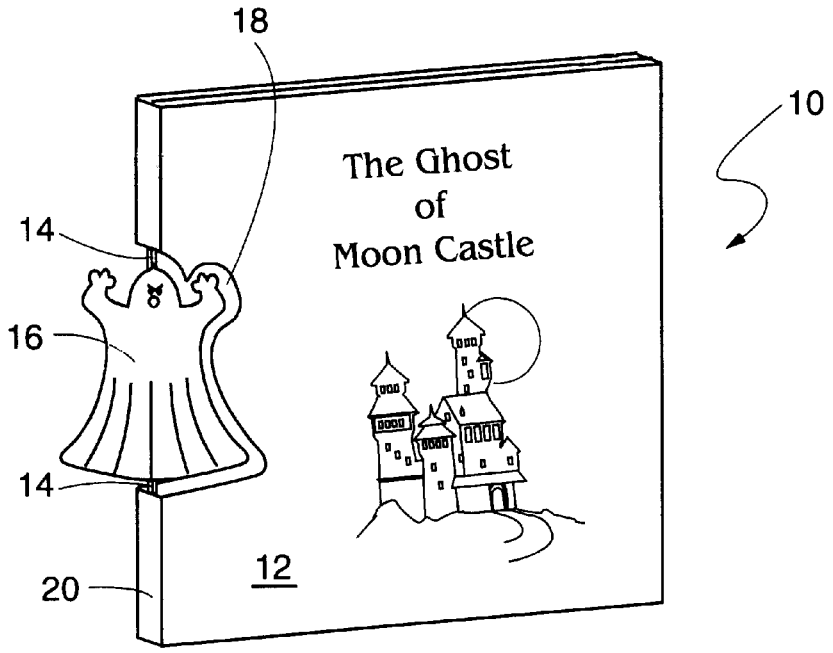
FIG. 1 is a perspective view of the closed book structure of the present invention.

The present invention is concerned with a printed article such as a book, especially a book including a figurine assembled within a cutout in the spine of the book. The figurines or figures generally relate to the printed subject matter contained within the book. Such a book can be a children's book where the figurine is designed to attract and hold the attention of a child. Such a book can also be aimed at older audiences where the figurine is a promotional or commercial article designed to promote or advertise any particular item or product.

By the term "printed article" as the term is used herein, is meant an article having printed material thereon, such an article being a book, a magazine, a pamphlet, a brochure or any other similar article typically formed of paper or the like and bound at one edge generally referred to as a spine. Materials other than paper may be employed in forming the pages, e.g., plastic, fabric and the like, so long as such materials can be printed upon so as to constitute a printed article.

As the term is used herein, "spine" is meant to refer to the edge of, e.g., a book whereat the various pages of the book are joined together. Other printed articles such as magazines, pamplets, brochures and the like can also contain a spine.

The three dimensional figurines can serve to enhance interest in the printed article, e.g., book, beyond an ordinary picture book. In one embodiment, the three dimensional figurines of the present invention are characterized as non-symmetrical in at least two of three principal axes, i.e., the figurines may have up to a single plane of reflection between, e.g., the left and right sides of a figure, e.g., a humanoid-type figure, but do not have more than one single plane of reflection. The three dimensional figurines of the present invention can include, e.g., humans, animals, humanoid-figures, sports-related items such as hats, helmets and the like. In another embodiment of the present invention, the three dimensional figurines are a promotional article or commercial article and such a promotional or commercial article can be representative of a recognizable product. For example, some well-known commercial products are recognizable by their design features or shape. Such a recognizable product can be incorporated into the spine of a printed article in accordance with the present invention to yield a unique promotional or commercial article. Exemplary items can include, e.g., pop bottles, automobile models, or selected food products such as hamburgers, pizza and the like.

The figurines used in the present invention can be formed of plastic, rubber or other synthetic materials, or may be of a fabric such as in a stuffed plush type figurine.

The cut-out in the spine of the printed article can be of any common geometrical shape, e.g., the cutout can be spherical, oval, triangular, rectangular, and the like. The cut-out in the spine of the printed article can also be of a non-symmetrical shape, such a shape preferably configured in the form of the outline of the figurine to be assembled within the spine. Use of a cut-out in the spine of a non-symmetrical shape is preferred in many instances.

The figurines attached to the spine in the defined cut-out region are viewable upon opening the book and preferably the figurine within the defined cut-out region is situated with graphic material forming the printed pages of the book to form a cooperative storyline. Thus, while the attached figurine will be seen within the defined cut-out region of the spine as the pages of the book are turned, the graphic material on each subsequent page combination will cooperate with the figurine.

The figurine can be attached to the printed article with an elastic string. In one embodiment, the figurine is attached or secured to the printed article by an elastic string passing through a hole centrally located at an axis of the figurine, preferably the longest major axis of the figurine. The elastic string can be attached to the printed article within the spine of the printed article at positions above and below the defined cut-out region. The elastic string can be a single piece, or can be a multiple piece string passing through the hole in the figurine and adfixed to the printed article. Other materials than elastic string can be employed to attach the figurine, materials such as string, wire, ribbon and the like, but elastic string is preferred as it allows the figurine to be gently pulled on with less risk of detachment.

In FIG. 1 is seen a closed view of a book structure or assembly of the present invention. A book structure 10 includes an outer page or cover 12, an elastic string 14 and a figurine 16. A cut-out region 18 in a spine 20 of book structure 10 can be seen to follow the outline of figurine 16. Other cut-out shapes may be employed but following the outline of the figurine is preferred.

Figure 2:
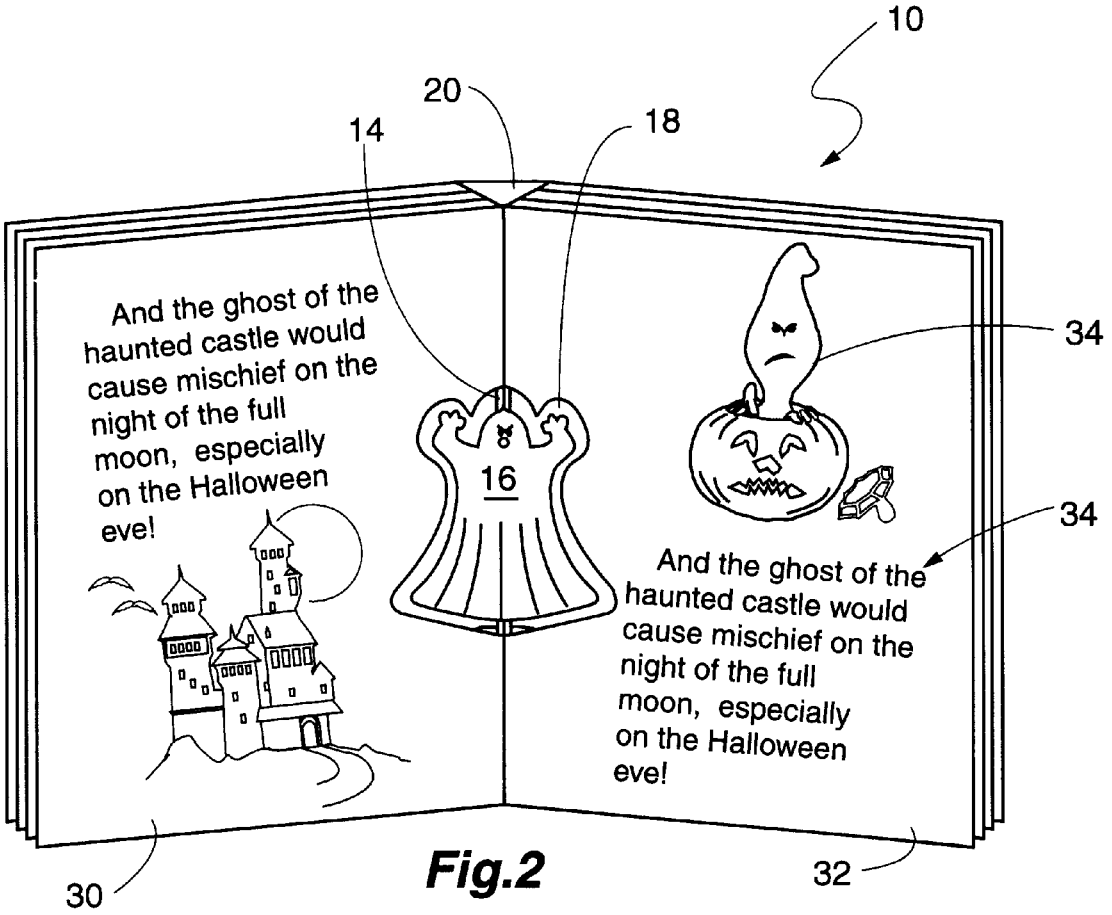
FIG. 2 is a perspective view of the open book structure including a cooperative storyline of the present invention.

In FIG. 2 is seen an open view of the book structure of the present invention. The book structure 10 includes pages 30 and 32 which includes some printed graphic material 34. Printed graphic material 34 can be seen to cooperate with figurine 16 floating in the cut-out region 18 of spine 20 to form a storyline. Elastic string 14 can also be seen from the interior of the book structure 10.

Figure 3:
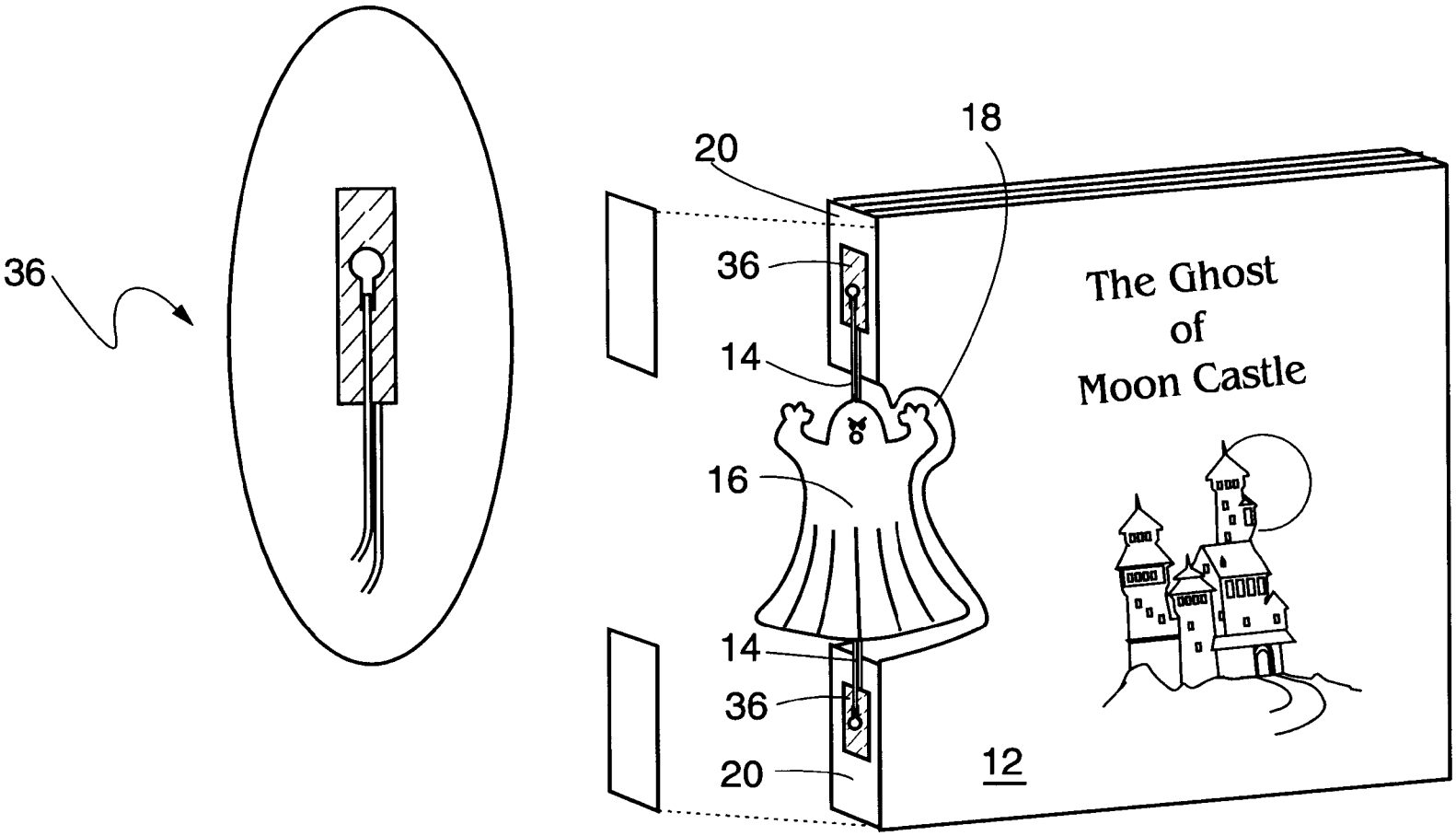
FIG. 3 is a cutaway view of the spine of the book and attachment of a figurine to the spine.

In FIG. 3 is seen the cutaway view of the spine of the book and attachment of figurine 16 to the spine 20. Elastic string 14 is shown looped around a securing means 36. Such securing means 36 can be a strip of paper with a hole through which the string is passed such a strip of paper then attached to the spine by an adhesive. Securing means 36 can also be a post around which an elastic string is looped, can be a spot of adhesive whereat an elastic string is affixed, or can be other attachment means well known to those skilled in the art of book binding.

Although the present invention has been described with reference to specific details, it is not intended that such details should be regarded as limitations upon the scope of the invention, except as and to the extent that they are included in the accompanying claims.

What is claimed is:

1. A printed article comprising a plurality of pages including printing thereon, each of said pages characterized as having a defined cutout region, said pages joined together at a spine such that the cutout region in each page is in alignment with each other cutout region at said spine, and a figurine characterized as having no more than a single plane of reflection, said figurine attached to said printed article at said spine by a securing means within said defined cutout region.

2. The printed article of claim 1 wherein the printing upon said pages forms a cooperative storyline with said figurine within said defined cutout region.

3. The printed article of claim 1 wherein the figurine is in a cooperative arrangement with said defined cutout region.

4. The printed article of claim 1 wherein said figurine is of a material selected from the group consisting of plastic and rubber.

5. The printed article of claim 1 wherein said figurine is a plush article.

6. The printed article of claim 1 wherein said figurine is attached by an elastic string.

7. The printed article of claim 1 wherein said figurine is a humanoid-figure.

8. The printed article of claim 1 wherein said figurine is a sports headware article.

9. The printed article of claim 1 wherein said printed article is book.

10. A printed article comprising a plurality of pages including printing thereon, each of said pages characterized as having a defined cutout region, said pages joined together at a spine such that the cutout region in each page is in alignment with each other cutout region at said spine, and a figurine characterized as representative of a commercial product, said figurine attached to said printed article at said spine by a securing means within said defined cutout region.

11. A printed article comprising a plurality of pages including printing thereon, each of said pages characterized as having a defined cutout region, said pages joined together at a spine such that the cutout region in each page is in alignment with each other cutout region at said spine, said defined cutout region characterized by a non-symmetrical shape.

* * * * *